US012092330B2

(12) United States Patent
Yoshida et al.

(10) Patent No.: US 12,092,330 B2
(45) Date of Patent: Sep. 17, 2024

(54) GAS TURBINE COMBUSTER

(71) Applicant: Mitsubishi Heavy Industries, Ltd., Tokyo (JP)

(72) Inventors: Shohei Yoshida, Yokohama (JP); Yoshitaka Hirata, Yokohama (JP); Akinori Hayashi, Yokohama (JP); Satoshi Dodo, Yokohama (JP); Hirokazu Takahashi, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 17/747,119

(22) Filed: May 18, 2022

(65) Prior Publication Data

US 2022/0275940 A1 Sep. 1, 2022

Related U.S. Application Data

(62) Division of application No. 17/071,557, filed on Oct. 15, 2020.

(30) Foreign Application Priority Data

Oct. 17, 2019 (JP) ..... 2019-190106

(51) Int. Cl.
*F23R 3/06* (2006.01)
*F23R 3/00* (2006.01)
(Continued)

(52) U.S. Cl.
CPC ..... *F23R 3/06* (2013.01); *F23R 3/002* (2013.01); *F23R 3/10* (2013.01); *F23R 3/28* (2013.01);
(Continued)

(58) Field of Classification Search
CPC .... F23R 3/06; F23R 2900/00014; F23R 3/44; F23R 3/60; F23R 2900/03043;
(Continued)

(56) References Cited

U.S. PATENT DOCUMENTS 4,872,312 A 10/1989 Iizuka et al.
7,013,647 B2 3/2006 Nishimura
(Continued)

FOREIGN PATENT DOCUMENTS

CN 101126353 A 2/2008
CN 102052673 A 5/2011
(Continued)

OTHER PUBLICATIONS

United States Final Office Action issued in U.S. Appl. No. 17/071,557 dated Dec. 5, 2022 (12 pages).
(Continued)

*Primary Examiner* — Thomas P Burke
*Assistant Examiner* — Jingchen Liu
(74) *Attorney, Agent, or Firm* — Crowell & Moring LLP

(57) ABSTRACT

A gas turbine combustor includes a vane, a plurality of supports, and a pressure dynamics damping hole. The vane is disposed at the outer circumferential side of the combustion liner. The plurality of supports are disposed at an inner side of the combustion casing for fixing the vane. The pressure dynamics damping hole is formed in the combustion liner at a position corresponding to the vane for communication with the combustion chamber.

2 Claims, 6 Drawing Sheets

(51) Int. Cl.

| | |
|---|---|
| ***F23R 3/10*** | (2006.01) |
| ***F23R 3/28*** | (2006.01) |
| ***F23R 3/44*** | (2006.01) |

(52) U.S. Cl.
CPC ..... *F23R 3/286* (2013.01); *F23R 3/44* (2013.01); *F23R 2900/00014* (2013.01); *F23R 2900/03043* (2013.01)

(58) Field of Classification Search
CPC ..... F23R 2900/03045; F23R 3/002; F05D 2260/96; F05D 2260/963–964; F02C 7/18; F02C 7/24
See application file for complete search history.

(56) References Cited

U.S. PATENT DOCUMENTS

| | | | |
|---|---|---|---|
| 8,307,657 | B2 | 11/2012 | Chila |
| 2003/0118963 | A1 | 6/2003 | Modi et al. |
| 2005/0107942 | A1 | 5/2005 | Nomura et al. |
| 2010/0005804 | A1 | 1/2010 | Chen et al. |
| 2011/0094235 | A1 | 4/2011 | Mulherin et al. |
| 2011/0127456 | A1 | 6/2011 | Kenyon et al. |
| 2011/0220433 | A1 | 9/2011 | Nakamura et al. |
| 2012/0131924 | A1 | 5/2012 | Yoshida et al. |
| 2012/0291438 | A1 | 11/2012 | Bethke |
| 2012/0297783 | A1 | 11/2012 | Melton et al. |
| 2013/0160453 | A1 | 6/2013 | Kimura et al. |
| 2015/0020498 | A1 | 1/2015 | Schilp |
| 2015/0226122 | A1 | 8/2015 | Duesing et al. |
| 2018/0180288 | A1 | 6/2018 | Kugimiya et al. |

FOREIGN PATENT DOCUMENTS

| | | | | | |
|---|---|---|---|---|---|
| CN | 102165263 | A | | 8/2011 | |
| CN | 102538008 | A | | 7/2012 | |
| CN | 104296160 | A | | 1/2015 | |
| CN | 205014429 | U | | 2/2016 | |
| CN | 105431684 | A | | 3/2016 | |
| DE | 10 2009 026 056 | A1 | | 1/2010 | |
| EP | 3242084 | A1 | | 11/2017 | |
| EP | 3 533 972 | A1 | | 9/2019 | |
| JP | 2003-207133 | A | | 7/2003 | |
| JP | 2011-117717 | A | | 6/2011 | |
| RU | 2012 103 903 | A | | 8/2013 | |
| WO | WO-9849496 | A1 | * | 11/1998 | ..... F23R 3/002 |
| WO | WO 2013/077394 | A1 | | 5/2013 | |

OTHER PUBLICATIONS

Chinese-language Office Action issued in Chinese Application No. 20201108458.5 dated Jan. 5, 2022 with English translation (10 pages).
German-language Office Action issued in German Application No. 10 2020 213 103.1 dated Feb. 3, 2022 with English translation (16 pages).
United States Non-Final Office Action issued in U.S. Appl. No. 17/071,557 dated Jun. 16, 2022 (33 pages).
Japanese-language Office Action issued in Japanese Application No. 2019-190106 dated Nov. 1, 2022 with English translation (six (6) pages).
United States Office Action issued in U.S. Appl. No. 17/071,557 dated May 12, 2023 (14 pages).
U.S. Final Office Action issued in U.S. Appl. No. 17/071,557 dated Sep. 15, 2023 (25 pages).

* cited by examiner

GAS TURBINE COMBUSTER

CROSS REFERENCE TO RELATED APPLICATIONS

This application is a divisional of U.S. patent application Ser. No. 17/071,557, filed Oct. 15, 2020, which claims priority to Japanese Patent Application No. 2019-190106, filed Oct. 17, 2019, the disclosures of all of which are expressly incorporated by reference herein.

BACKGROUND OF THE INVENTION

The present invention relates to a gas turbine combustor.

Gas turbine combustors of some type use liquefied natural gas as fuel. In this case, from an aspect of global environment conservation, a premixed combustion mode for combustion of air-fuel premixture is employed to suppress emission of nitrogen oxides (NOx) as a cause of air pollution.

In the premixed combustion mode, the air-fuel premixture may suppress generation of a locally high-temperature combustion region in burning. It is therefore possible to suppress generation of nitrogen oxides from the high-temperature combustion region.

Generally, the premixed combustion mode succeeds in suppressing quantity of generated nitrogen oxides. However, in a certain case, the mode fails to stabilize the combustion state, leading to combustion oscillation that periodically fluctuates the pressure in the combustion chamber. Therefore, the premixed combustion mode is combined with the diffusion combustion mode excellent in stabilizing the combustion state.

When using both the diffusion combustion mode and the premixed combustion mode for suppressing quantity of generated nitrogen oxides, there may be the case that the proportion of the premixed combustion to the diffusion combustion is increased, or the premixed combustion is fully performed. In the above-described case, an acoustic liner for attenuating pressure fluctuation owing to combustion oscillation is attached to an outer circumferential surface of the combustion liner constituting the combustion chamber for the purpose of attenuating the pressure fluctuation owing to the combustion oscillation.

An example of a background of the above-described technology includes WO2013/077394.

The disclosed gas turbine combustor includes a combustion cylinder and an acoustic liner attached to an outer side of the combustion cylinder for forming space from the outer circumferential surface of the combustion cylinder. The combustion cylinder includes a group of through holes. The through holes are formed at intervals circumferentially in a plurality of rows, and arranged in axial rows at intervals (see description in SUMMARY OF THE INVENTION of WO2013/077394).

SUMMARY OF THE INVENTION

WO2013/077394 discloses the gas turbine combustor including the acoustic liner. The disclosed acoustic liner is attached to the combustion cylinder (combustion liner).

If the disclosed acoustic liner is attached to the combustion liner as a high-temperature component, the cooling process is required by supplying purge air into the space between the acoustic liner and the combustion liner for securing mechanical reliability.

It is an object of the present invention to provide a gas turbine combustor with a relatively simple structure for attenuating the pressure fluctuation owing to combustion oscillation while securing the mechanical reliability.

The gas turbine combustor according to the present invention includes a combustion liner that forms a combustion chamber for generating combustion gas, a combustion casing disposed at an outer circumferential side of the combustion liner, and a burner for supplying air flowing between the combustion liner and the combustion casing, and fuel to be supplied from a fuel supply system to the combustion chamber. The gas turbine combustor further includes a vane disposed at the outer circumferential side of the combustion liner, a plurality of supports disposed at an inner side of the combustion casing for fixing the vane, and a pressure dynamics damping hole formed in the combustion liner at a position corresponding to the vane for communication with the combustion chamber.

The present invention provides a gas turbine combustor with a relatively simple structure for attenuating the pressure fluctuation owing to the combustion oscillation while securing the mechanical reliability.

Problems, structures, and advantageous effects other than those described above will be clarified by descriptions of the following examples.

DETAILED DESCRIPTION OF THE PREFERRED EMBODIMENTS

Hereinafter, an explanation will be made with respect to examples according to the present invention with reference to the drawings. Substantially the same or similar structures will be designated with the same codes, and repetitive explanations thereof, thus, will be omitted.

First Example

An explanation will be made conceptually with respect to the gas turbine power generation facility provided with a gas turbine combustor 3 (hereinafter referred to as a combustor) according to a first example.

Figure 1:
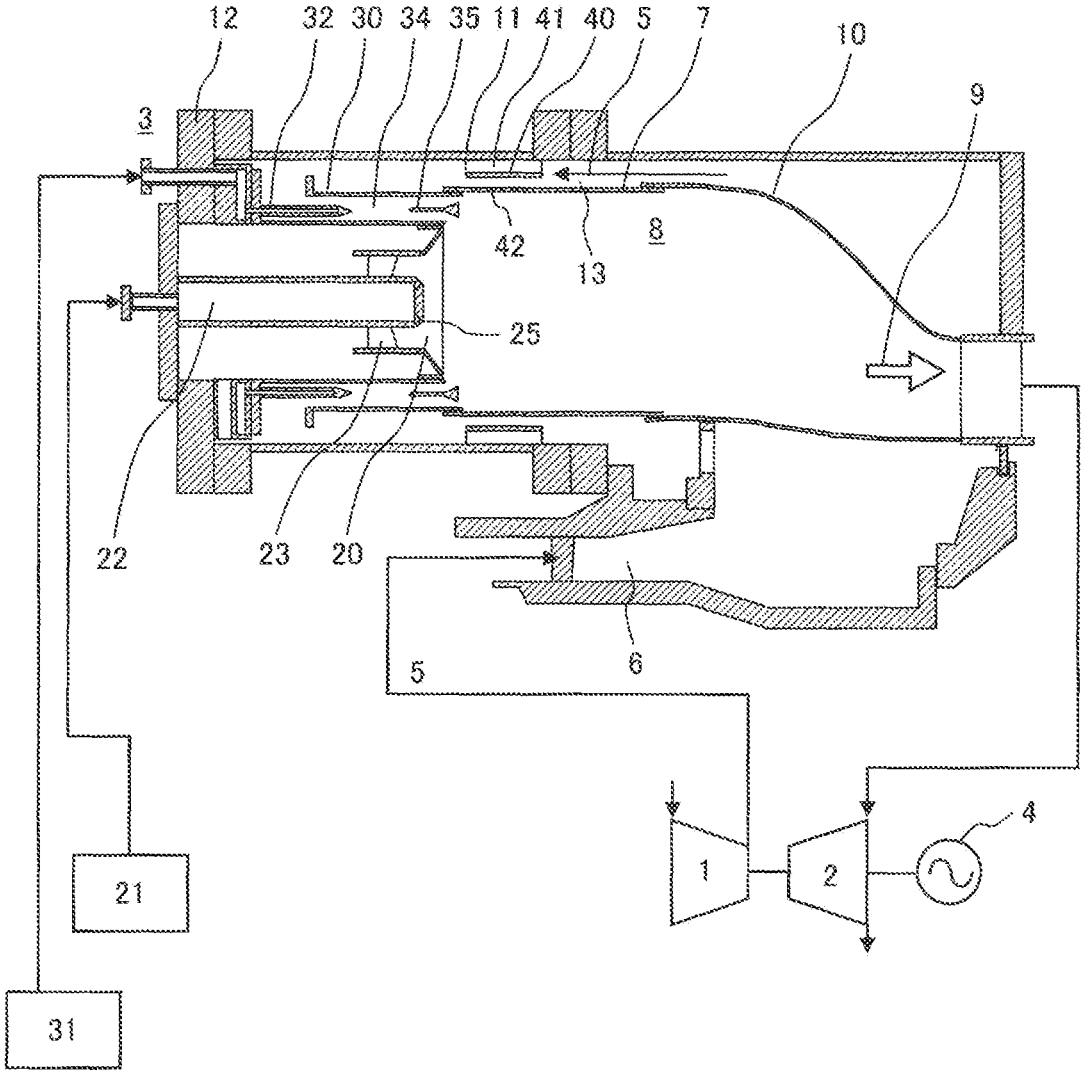
FIG. 1 conceptually illustrates a gas turbine power generation facility provided with a gas turbine combustor 3 to be described in a first example.

FIG. 1 conceptually illustrates the gas turbine power generation facility provided with the combustor 3 according to the first example.

The gas turbine power generation facility (gas turbine power plant) provided with the combustor 3 according to the first example includes a turbine 2, a compressor 1 connected to the turbine 2 for generating compressed air 5 for combustion, a plurality of gas turbine combustors 3, and a generator 4 connected to the turbine 2 for generating power in association with driving of the turbine 2. FIG. 1 shows one unit of the combustor 3 for convenience of explanation.

The compressed air 5 discharged from the compressor 1 is supplied to the combustor 3 via a compressed air passage 6. In a combustion chamber 8 formed inside a combustion liner 7 for combustor (hereinafter referred to as a combustion liner), combustion gas 9 is generated by burning the compressed air 5 and the fuel. The combustion gas 9 is supplied to the turbine 2 for driving via a transition piece 10.

The combustor 3 includes a diffusion burner 20, a premix burner 30, the combustion liner 7, the transition piece 10, a casing 11 for combustor (hereinafter referred to as a combustion casing), and an end cover 12. The diffusion burner 20 receives fuel supplied from a diffusion fuel supply system 21, and the premix burner 30 receives fuel supplied from a premix fuel supply system 31.

The diffusion burner 20 has a fuel jet hole 25 through which the diffusion fuel spouts via a fuel passage (fuel nozzle) 22. The diffusion burner 20 is provided with a swirler 23 for imparting a swirling component to air for combustion (compressed air 5). The diffusion burner 20 mixes the diffusion fuel with air for combustion, to which the swirling component is imparted by the swirler 23 to generate a diffusion flame downstream from the diffusion burner 20.

The premix burner 30 allows a premixer 34 to preliminarily mix premix fuel spouting through a fuel passage (fuel nozzle) 32 with the air for combustion (compressed air 5). A premix flame is generated by a mixture of the premix fuel and the compressed air 5 downstream from a flame stabilizer 35.

The combustor 3 includes a vane 40 and a plurality of supports 41 in an annular passage 13 formed between the combustion liner 7 that constitutes the combustion chamber 8 for generating the combustion gas 9 and the combustion casing 11 that encases the combustion liner 7 (disposed at the outer circumferential side of the combustion liner 7). The vane 40 is disposed at the outer circumferential side of the combustion liner 7 in the annular passage 13. The support 41 is attached to an inner side of the combustion casing 11 in the annular passage 13 for fixing the vane 40.

The combustor 3 has a pressure dynamics damping hole 42 in the combustion liner 7 at a position corresponding to the vane 40 for communication with the combustion chamber 8.

A main part of the combustor 3 according to the first example will be briefly described.

Figure 2:
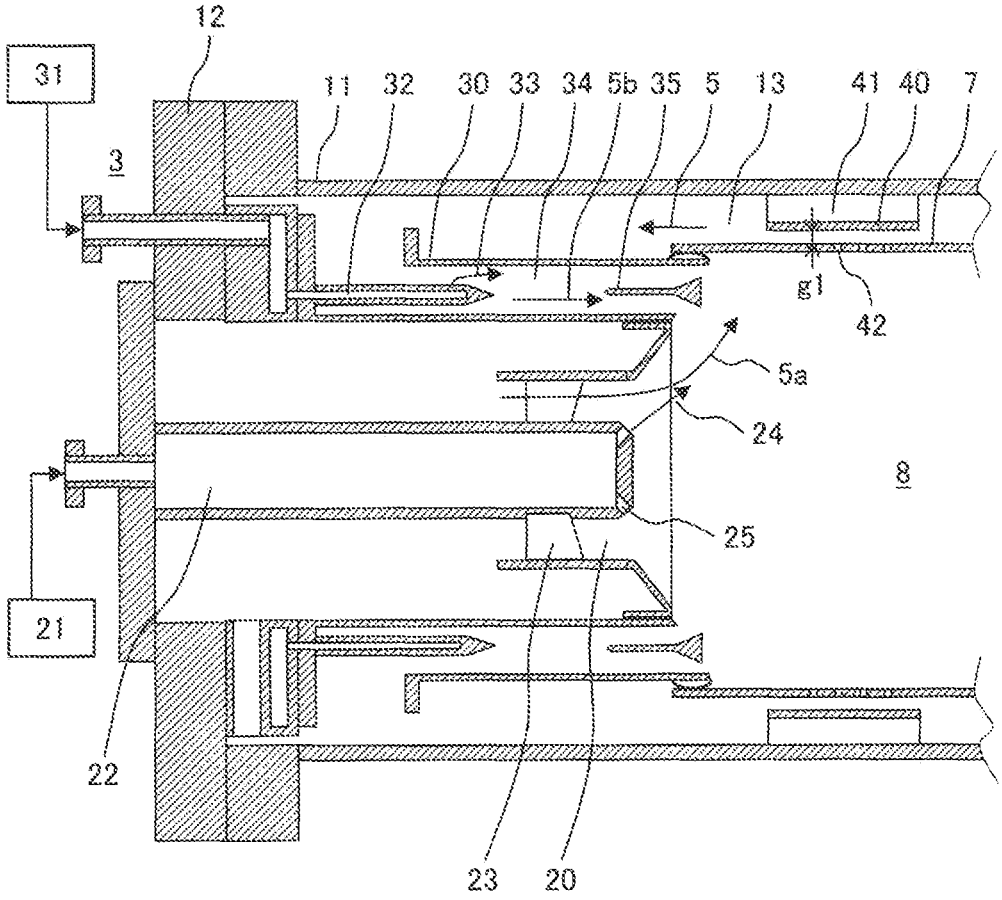
FIG. 2 is a schematic partially enlarged sectional view of a main part of the gas turbine combustor 3 to be described in the first example.

FIG. 2 is a schematic partially enlarged sectional view of the main part of the combustor 3 according to the first example.

In the diffusion burner 20, diffusion fuel 24 flowing through the fuel passage (fuel nozzle) 22 spouts through the fuel jet hole 25. The diffusion fuel 24 is mixed with air 5*a* for combustion (compressed air 5) to which the swirling component is imparted by the swirler 23 so that a diffusion flame is generated downstream from the diffusion burner 20. In other words, the diffusion burner 20 supplies the air 5*a* for combustion and the diffusion fuel 24 to the combustion chamber 8.

The premix burner 30 allows the premixer 34 to mix premix fuel 33 spouting through the fuel passage 32 with air 5*b* for combustion (compressed air 5). The sufficiently mixed mixture of the premix fuel 33 and the compressed air 5*b* generates the premix flame downstream from the flame stabilizer 35. In other words, the premix burner 30 is disposed at an outer circumferential side of the diffusion burner 20 for supplying the air 5*b* for combustion and the premix fuel 33 to the combustion chamber 8.

Upon reception of thermal energy from the diffusion flame, the premix flame stably burns in the combustion chamber 8 (suppressing generation of the locally high-temperature combustion region in burning). This makes it possible to suppress quantity of generated nitrogen oxides.

The combustor 3 includes the vane 40 and the supports 41 in the annular passage 13 formed between the combustion liner 7 that constitutes the combustion chamber 8, and the combustion casing 11 that encases the combustion liner 7. The vane 40 is disposed in the annular passage 13 at the outer circumferential side of the combustion liner 7. The support 41 is attached to the inner side of the combustion casing 11 in the annular passage 13 for fixing the vane 40. The combustor 3 further has the pressure dynamics damping hole 42 in the combustion liner 7 at the position corresponding to the vane 40 (combustion liner 7 at the position corresponding to the part where the vane 40 is formed) for communication with the combustion chamber 8.

The vane 40 and the supports 41 are disposed in the annular passage 13 formed at an outer circumferential side of the combustion chamber 8. Especially, it is preferable to dispose the vane and the supports downstream (around an outer circumferential side of the flame stabilizer 35) in the flow direction of the compressed air 5 flowing through the annular passage 13.

The supports 41 are attached to the inner side of the combustion casing 11 in the circumferential direction while extending to the center for fixing the vane 40 to the combustion casing 11. For example, four supports 41 may be attached in the circumferential direction. Preferably, the support 41 has a streamlined cross section so that turbulence of the compressed air 5 is suppressed.

The vane 40 is an annular member (formed by continuously surrounding the outer circumferential side of the combustion liner 7) attached to the support 41 in the annular passage 13, having a predetermined width in the axial direction of the combustion liner 7. In other words, the vane 40 is disposed between the inner circumferential side of the combustion casing 11 and the outer circumferential side of the combustion liner 7 (annular passage 13), and fixed to the combustion casing 11 via the support 41. The vane 40 is disposed substantially parallel to the combustion liner 7 in the radial direction of the annular passage 13. In other words, the vane 40 is disposed in the annular passage 13 formed between the combustion liner 7 and the combustion casing 11 at a position around the outer circumferential side of the flame stabilizer 35 (downstream in the flow direction of the compressed air 5 flowing through the annular passage 13).

The pressure dynamics damping hole 42 is formed in the combustion liner 7 at a position corresponding to a part where the vane 40 is disposed (combustion liner 7 facing the vane 40 in the radial direction, in other words, at the position corresponding to the vane 40) for communication between the combustion chamber 8 and the annular passage 13.

A plurality of pressure dynamics damping holes 42 are formed in the row in a circumferential direction of the combustion liner 7. The circumferential rows are arranged in an axial direction. Each interval among the pressure dynamics damping holes 42 in the circumferential direction may be set to a fixed value or an irregular value. Preferably, the pressure dynamics damping holes 42 in one of the rows at predetermined intervals, and those in the next row are formed in a zigzag arrangement.

Namely, the combustor 3 according to the first example includes the combustion liner 7 that constitutes the combustion chamber 8 for generating the combustion gas 9, the combustion casing 11 that encases the combustion liner 7 at its outer circumferential side, burners (diffusion burner 20 for supplying the air 5*a* for combustion and the diffusion fuel 24 to the combustion chamber 8, and a premix burner 30 disposed at an outer circumferential side of the diffusion burner 20 for supplying the air 5*b* for combustion and the premix fuel 33 to the combustion chamber 8) for supplying air for combustion, flowing through the annular passage 13 formed between the combustion liner 7 and the combustion casing 11, and the fuel (the diffusion fuel 24, and the premix fuel 33) supplied from the fuel supply system (the diffusion fuel supply system 21, and the premix fuel supply system 31).

The combustor 3 includes the vane 40, the supports 41, and the pressure dynamics damping hole 42. The vane 40 is disposed in the annular passage 13 formed between the combustion liner 7 and the combustion casing 11 (outer circumferential side of the combustion liner 7 and inner circumferential side of the combustion casing 11) downstream in the flow direction of the compressed air 5 flowing through the annular passage 13. The supports 41 are disposed at the inner side of the combustion casing 11 for fixing the vanes 40. The pressure dynamics damping hole 42 is formed in the combustion liner 7 at the position corresponding to the part where the vane 40 is formed for communication with the combustion chamber 8.

The combustor 3 with a relatively simple structure attenuates the pressure fluctuation owing to the combustion oscillation while securing the mechanical reliability. The vanes 40 and the supports 41 allow the compressed air 5 flowing through the annular passage 13 to smoothly flow while suppressing pressure loss.

Preferably, the position where the pressure dynamics damping hole 42 is formed (position at which the vane 40 is disposed) corresponds to the position as a base point where the flame stabilizer 35 starts generating the premix flame. This makes it possible to introduce the compressed air 5 into the base point of the premix flame through the pressure dynamics damping hole 42.

Especially when the pressure dynamics damping holes 42 are irregularly formed in the circumferential direction, properties of the premix flame (flame shape and flame temperature) may be made non-uniform in the circumferential direction of the ring-shaped premix flame. This makes it possible to suppress increase in an amplitude value of the combustion oscillation.

The pressure wave generated by the combustion oscillation in the combustion chamber 8 is propagated to the annular passage 13 via the pressure dynamics damping hole 42 formed in the combustion liner 7, and reflected by the vane 40. In other words, the pressure wave propagated to the annular passage 13 is reflected by the vane 40, and then attenuated to suppress increase in the amplitude value of the combustion oscillation. The pressure wave is attenuated as a result of attenuating energy of the combustion oscillation.

It is preferable to design a gap g1 between the outer circumference (outer circumferential surface) of the combustion liner 7 and the inner circumference (inner circumferential surface) of the vane 40 based on the frequency of the pressure wave generated by the combustion oscillation. It is preferable to design the gap g1 in consideration of the phase of the pressure wave propagated to the annular passage 13, and the phase of the reflection wave reflected by the vane 40. This makes it possible to attenuate the pressure wave propagated to the annular passage 13, and suppress increase in the amplitude value of the combustion oscillation.

Since the frequency of the attenuating pressure wave varies under the combustion conditions (load of the turbine 2, that is, fuel flow rate, flow rate of the compressed air 5), it is preferable to use the frequency of the pressure wave generated under the combustion condition at the rated load of the turbine 2 on the assumption of a long operation period.

The combustor according to the first example keeps quantity of generated nitrogen oxides low for maintaining the stable combustion state (stable flame burning), and suppresses the combustion oscillation that periodically fluctuates the pressure in the combustion chamber 8 (holding the amplitude value of the combustion oscillation at a predetermined level or lower).

The combustor according to the first example has a relatively simple structure, and is capable of suppressing increase in the amplitude value of the combustion oscillation generated in burning. The combustor secures the mechanical reliability of the member (vane 40) that attenuates the pressure fluctuation owing to the combustion oscillation.

Second Example

A main part of the combustor 3 according to a second example will be briefly described.

Figure 3:
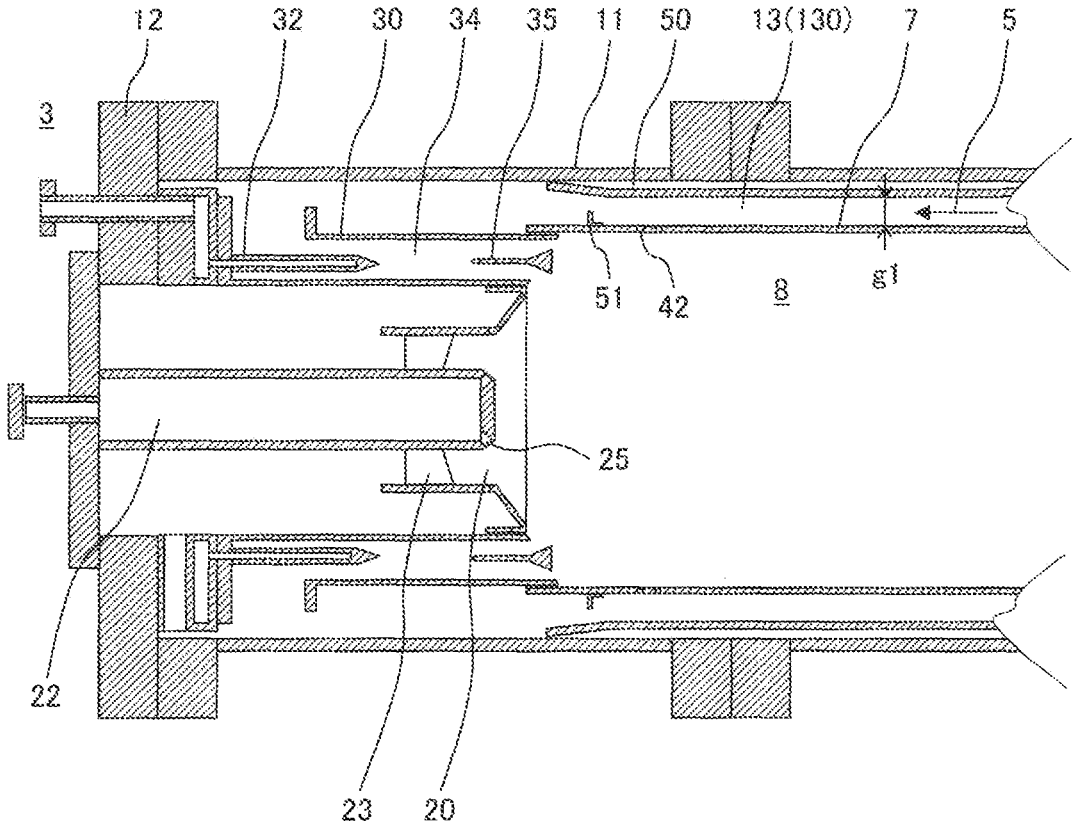
FIG. 3 is a schematic partially enlarged sectional view of a main part of the gas turbine combustor 3 to be described in a second example.

FIG. 3 is a schematic partially enlarged sectional view of the main part of the combustor 3 according to the second example.

The combustor 3 according to the second example is different from the combustor 3 according to the first example in the use of a flow sleeve 50 instead of the supports 41 and the vane 40.

The flow sleeve 50 is an annular member disposed in the annular passage 13 in substantially parallel to the combustion liner 7 in the radial direction of the annular passage 13 for narrowing its cross section area through which the compressed air 5 flows.

The flow sleeve 50 is disposed to expand toward the outer circumferential side downstream in the flow direction of the compressed air 5 flowing through the annular passage 13 (around the outer circumferential side of the flame stabilizer 35). The flow sleeve 50 is fixed to the inner circumferential side of the combustion casing 11.

The flow sleeve 50 has a part extending substantially parallel to the combustion liner 7, and the other part expanding toward the outer circumference.

The flow sleeve 50 reflects the pressure wave propagated to an annular passage 130 (narrowed annular passage 13) via the pressure dynamics damping hole 42 formed in the combustion liner 7. The pressure dynamics damping hole 42 is formed in the combustion liner 7 in substantially parallel thereto at the position corresponding to the flow sleeve 50.

Specifically, the combustor 3 according to the second example includes the combustion liner 7 that constitutes the combustion chamber 8 for generating the combustion gas 9, the combustion casing 11 disposed at the outer circumferential side of the combustion liner 7, and the burners (the diffusion burner 20 and the premix burner 30) for supplying the compressed air 5 flowing between the combustion liner 7 and the combustion casing 11, and the fuel (the diffusion fuel 24 and the premix fuel 33) supplied from the fuel supply system (the diffusion fuel supply system 21 and the premix fuel supply system 31).

The combustor 3 includes the flow sleeve 50 disposed at the outer circumferential side of the combustion liner 7, and the pressure dynamics damping hole 42 formed in the combustion liner 7 at the position corresponding to the flow sleeve 50 for communication with the combustion chamber 8.

The pressure wave generated by the combustion oscillation in the combustion chamber 8 is propagated to the annular passage 130 via the pressure dynamics damping hole 42 formed in the combustion liner 7, and reflected by the flow sleeve 50. The pressure wave propagated to the annular passage 130 is reflected by the flow sleeve 50, and then attenuated so that increase in the amplitude value of the combustion oscillation is suppressed. The flow sleeve 50 attenuates the pressure fluctuation owing to the combustion oscillation, and improves effect for cooling the combustion liner 7, a flow velocity of the compressed air 5, and an effect for rectifying the compressed air 5.

When providing the flow sleeve 50 in the combustor 3, the gap g1 between the outer circumference (outer circumferential surface) of the combustion liner 7 and the inner circumference (inner circumferential surface) of the flow sleeve 50 is designed based on the frequency of the pressure wave generated by the combustion oscillation. In other words, the gap g1 is designed in accordance with the combustor 3 for adjusting the cross section area of the annular passage 13. The flow sleeve 50 is designed in consideration of the predetermined performance of the combustor 3 (cooling of the combustion liner 7, flow velocity and rectification of the compressed air 5).

As described above, the gap g1 is designed based on the frequency of the pressure wave generated by the combustion oscillation, and the predetermined performance of the combustor 3.

Preferably, the position at which the pressure dynamics damping hole 42 is formed corresponds to the position as the base point where the flame stabilizer 35 starts generating the premix flame. This makes it possible to introduce the compressed air 5 into the position as the base point of the premix flame through the pressure dynamics damping hole 42.

Especially when forming the pressure dynamics damping holes 42 irregularly in the circumferential direction, properties of the premix flame may be made non-uniform in the circumferential direction of the ring-like shaped premix flame. As the premix flame properties are made non-uniform in the circumferential direction, increase in the amplitude value of the combustion oscillation may be suppressed.

The pressure dynamics damping holes 42 are formed downstream (around the outer circumference of the flame stabilizer 35) in the flow direction of the compressed air 5 flowing through the annular passage 13 for communication between the combustion chamber 8 and the annular passage 13. The pressure dynamics damping holes 42 are arranged in the row in the circumferential direction of the combustion liner 7. A plurality of rows (two rows in the second example) in the circumferential direction are arranged in the axial direction. The pressure dynamics damping holes 42 either in the single row or three or more rows may suppress increase in the amplitude value of the combustion oscillation.

If the pressure dynamics damping holes 42 are formed in many rows in the axial direction, the flow rate of the compressed air 5 to be introduced into the combustion chamber 8 through the pressure dynamics damping holes 42 will be increased. As a result, the effect for suppressing increase in the amplitude value of the combustion oscillation is enhanced. However, the flow rate of the air for combustion is reduced to increase quantity of generated nitrogen oxides. The pressure dynamics damping holes 42 are designed in consideration of the balance between the flow rate of the compressed air 5 introduced into the combustion chamber 8 through the pressure dynamics damping holes 42 and the flow rate of the air for combustion.

Preferably, the combustor 3 includes a rib 51 has an annular member disposed at the outer circumferential side of the combustion liner 7 downstream from the pressure dynamics damping holes 42 (downstream in the flow direction of the compressed air 5 flowing through the annular passage 13). The rib 51 is capable of adjusting the flow velocity of the compressed air 5 flowing through an annular passage 130 formed between the outer circumference of the combustion liner 7 and the inner circumference of the flow sleeve 50 in accordance with the specification (size, configuration) and the attachment position.

The pressure wave generated by the combustion oscillation in the combustion chamber 8 is propagated to the annular passage 130 via the pressure dynamics damping holes 42, and reflected by the flow sleeve 50. The flow velocity of the compressed air 5 flowing through the annular passage 130 may affect the pressure wave attenuating performance. The rib 51 serves to adjust the flow velocity of the compressed air 5 flowing through the annular passage 130 to maintain the pressure wave attenuating performance.

In the second example, the rib 51 is attached to the outer circumference of the combustion liner 7 downstream from the pressure dynamics damping holes 42. The rib 51 may also be attached to the outer circumference of the combustion liner 7 upstream from the pressure dynamics damping holes 42. Alternatively, each of the ribs 51 may be attached to the outer circumference of the combustion liner 7 upstream and downstream from the pressure dynamics damping holes 42, respectively. The rib in any of the above-described cases is capable of adjusting the flow velocity of the compressed air 5 flowing through the annular passage 130.

The rib 51 may be formed in the combustor 3 according to the first example. The rib 51 does not have to be necessarily formed in the combustor 3 according to the second example.

The combustor according to the second example suppresses quantity of generated nitrogen oxides to maintain the stable combustion state (stable flame burning), and ensures to suppress the combustion oscillation that periodically fluctuates the pressure in the combustion chamber 8 (holding the amplitude value of the combustion oscillation at a uniform level or lower).

The combustor according to the second example has a relatively simple structure, and is capable of suppressing increase in the amplitude value of the combustion oscillation in burning. The combustor secures mechanical reliability of the member (flow sleeve 50) for attenuating the pressure fluctuation owing to the combustion oscillation.

Third Example

A main part of the combustor 3 according to a third example will be briefly described.

Figure 4:
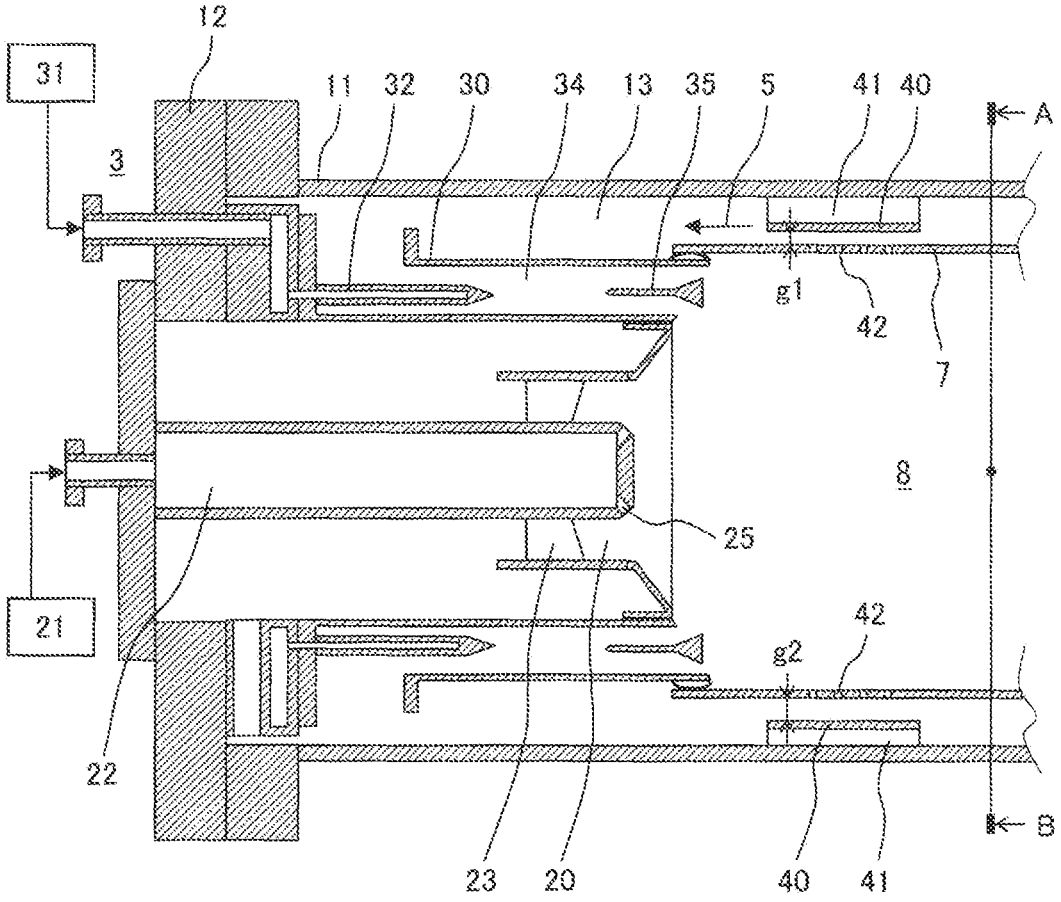
FIG. 4 is a schematic partially enlarged sectional view of a main part of the gas turbine combustor 3 to be described in a third example.

FIG. 4 is a schematic partially enlarged sectional view of the main part of the combustor 3 according to the third example.

The combustor 3 according to the third examples is different from the combustor 3 according to the first example in the state where the supports 41 and the vane 40 are disposed in the circumferential direction.

The combustor 3 according to the first example is configured to set the uniform gap g1 between the outer circumference (outer circumferential surface) of the combustion liner 7 and the inner circumference (inner circumferential surface) of the vane 40 in the circumferential direction. Meanwhile, the combustor 3 according to the third example is configured to set the non-uniform gap between the outer circumference (outer circumferential surface) of the combustion liner 7 and the inner circumference (circumferential surface) of the vane 40 in the circumferential direction.

Specifically, in the third example, the gap between the outer circumference of the combustion liner 7 and the inner circumference of the vane 40 is made variable in the circumferential direction of the combustion liner 7. At a position A of the combustion liner 7 in the circumferential direction, the distance between the outer circumferential surface of the combustion liner 7 and the inner circumferential surface of a vane 40*a* is set to the gap g1. At a position B of the combustion liner 7 in the circumferential direction, the distance between the outer circumferential surface of the combustion liner 7 and the inner circumferential surface of a vane 40*d* is set to a gap g2.

In the third example, the gap formed between the outer circumferential surface of the combustion liner 7 and the inner circumferential surface of the vane 40 becomes different in the circumferential direction of the combustion liner 7.

An explanation will be made with respect to the combustor 3 according to the third examples when it is seen from the combustion chamber.

Figure 5:
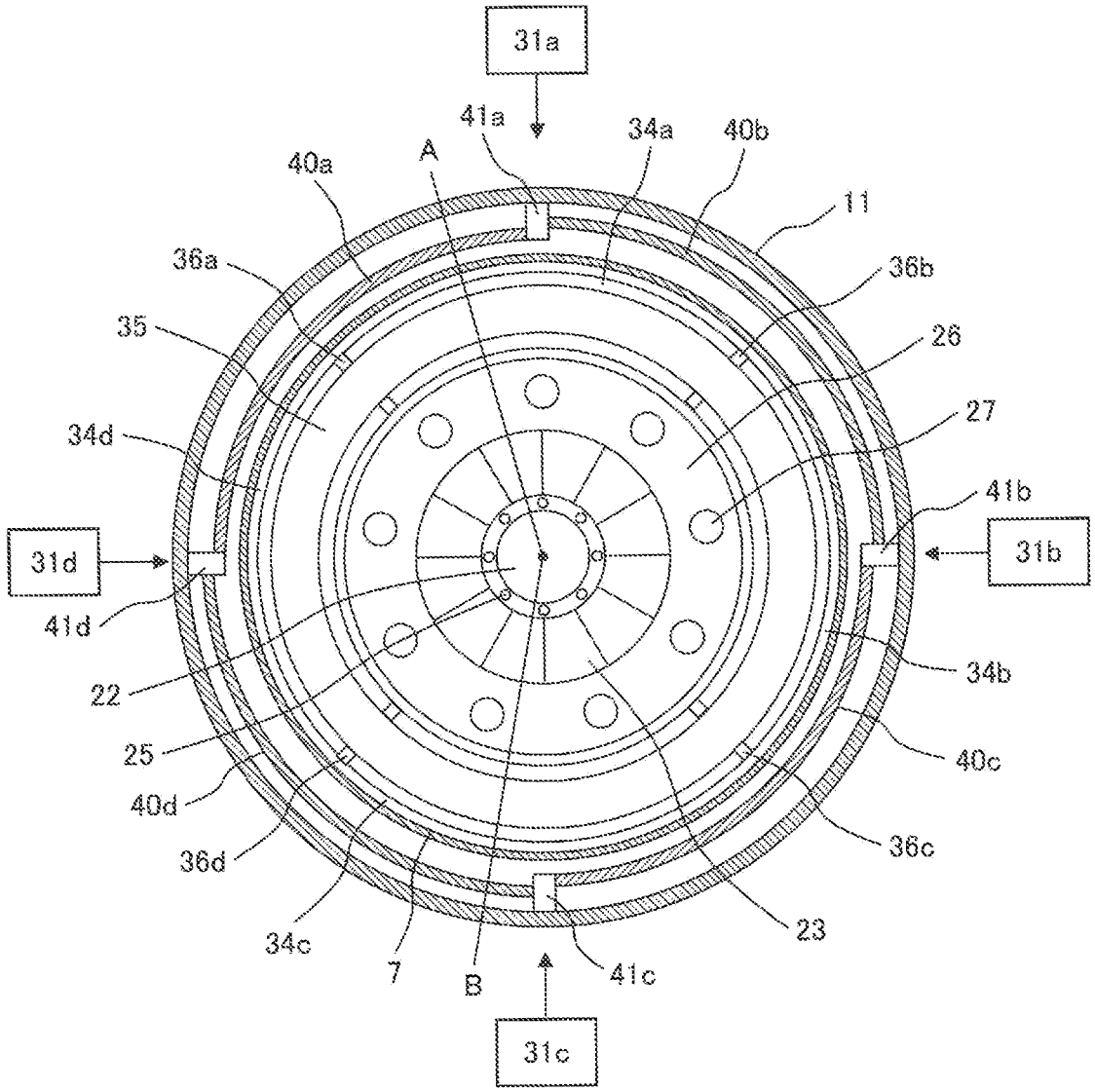
FIG. 5 is a schematic view of the gas turbine combustor 3 to be described in the third example when it is seen from a combustion chamber.

FIG. 5 is a schematic view of the gas turbine combustor 3 according to the third example when it is seen from the combustion chamber.

The combustor 3 according to the third example has the premix burner 30 divided by four premix burner partitions 36*a*, 36*b*, 36*c*, and 36*d*. The premixer 34 is divided into four premixers 34*a*, 34*b*, 34*c*, and 34*d*. The premix fuel supply system 31 for supplying the premix fuel to the premix burner 30 is divided into four premix fuel supply systems 31*a*, 31*b*, 31*c*, and 31*d* correspondingly. Each of the premix fuel supply systems supplies the premix fuel to the premixers 34*a*, 34*b*, 34*c*, and 34*d*, individually.

Four supports 41*a*, 41*b*, 41*c*, and 41*d* are disposed at positions corresponding to the four premixers 34*a*, 34*b*, 34*c*, and 34*d*, correspondingly at each center of the premixers at the outer circumferential side. The four supports 41*a*, 41*b*, 41*c*, and 41*d* extend from the inner side of the combustion casing 11 toward the center, and arranged at equal intervals along the circumference of the combustion casing 11.

The vanes 40*a*, 40*b*, 40*c*, and 40*d* are fixed to the four supports 41*a*, 41*b*, 41*c*, and 41*d*, respectively. Specifically, the vane 40*b* extends between the supports 41*a* and 41*b*, the vane 40*c* extends between the supports 41*b* and 41*c*, the vane 40*d* extends between the supports 41*c* and 41*d*, and the vane 40*a* extends between the supports 41*d* and 41*a*.

Each of the gap between the outer circumference of the combustion liner 7 and the inner circumference of the vane 40*a*, and the gap between the outer circumference of the combustion liner 7 and the inner circumference of the vane 40*c* is set to the gap g1. Each of the gap between the outer circumference of the combustion liner 7 and the inner circumference of the vane 40*b*, and the gap between the outer circumference of the combustion liner 7 and the inner circumference of the vane 40*d* is set to the gap g2.

The position A of the combustion liner 7 in the circumferential direction as shown in FIG. 4 corresponds to the position A as shown in FIG. 5. The position B of the combustion liner 7 in the circumferential direction as shown in FIG. 4 corresponds to the position B as shown in FIG. 5.

A cone 26 supports the diffusion burner 20, and has air holes 27 formed therein.

Two kinds of gaps (g1 and g2) may be formed in the combustor 3 according to the third example. This makes it possible to suppress increase in the amplitude value of the combustion oscillation to each frequency of two kinds of pressure waves generated by the combustion oscillation. In other words, two kinds of phases (phase of the wave reflected by the vane 40) may be considered for cancelling phases of the two kinds of pressure waves.

An explanation will be made with respect to a method of operating the gas turbine combustor 3 according to the third example.

Figure 6:
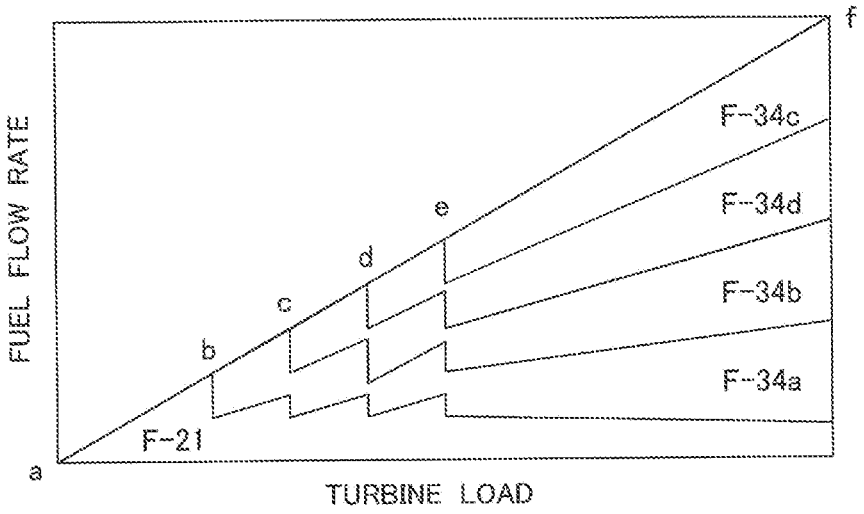
FIG. 6 schematically represents a method of operating the gas turbine combustor 3 to be described in the third example.

FIG. 6 schematically illustrates the method of operating the gas turbine combustor 3 according to the third example, having an x-axis representing the load of the turbine 2, and a y-axis representing the flow rate of the fuel supplied to each burner (the diffusion burner 20 and the premix burner 30).

The flow rate of the fuel to the diffusion burner 20 is designated as fuel F-21. The premix fuel supplied to the premixer 34*a* is designated as fuel F-34*a*. The premix fuel supplied to the premixer 34*b* is designated as fuel F-34*b*. The premix fuel supplied to the premixer 34*c* is designated as fuel F-34*c*. The premix fuel supplied to the premixer 34*d* is designated as fuel F-34*d*. A point a denotes a no-load state at a rated speed, and a point f denotes a rated load.

In a load range from the point a to the point b, the fuel F-21 is supplied to the diffusion burner 20.

When the load reaches the point b, supply of the fuel F-21 is reduced, and the fuel F-34*a* is supplied to the premixer 34*a* for starting premixed combustion.

As the load is increased, each supply of the fuel F-21 and F-34*a* is increased in the load range from the point b to the point c.

When the load reaches the point c, each supply of the fuel F-21 and F-34*a* is reduced, and the fuel F-34*b* is supplied to the premixer 34*b*.

As the load is increased, each supply of the fuel F-21, F-34*a*, and F-34*b* is increased in the load range from the point c to the point d.

When the load reaches the point d, each supply of the fuel F-21, F-34*a*, and F-34*b* is reduced, and the fuel F-34*d* is supplied to the premixer 34*d*.

As the load is increased, each supply of the fuel F-21, F-34*a*, F-34*b*, and F-34*d* is increased in the load range from the point d to the point e.

When the load reaches the point e, each supply of the fuel F-21, F-34*a*, F-34*b*, and F-34*d* is reduced, and the fuel F-34*c* is supplied to the premixer 34*c*.

As the load is increased, full-burner combustion is started in the load range from the point e to the point f.

Under the load at the point f (rated load), the supply of the fuel F-21 to the diffusion burner 20 is reduced for suppressing quantity of generated nitrogen oxides. Then each ratio of the premix fuel (F-34*a*, F-34*b*, F-34*c*, and F-34*d*) supplied to the premixers 34*a*, 34*b*, 34*c*, and 34*d* to the F-21 is increased.

Referring to FIG. 6, the combustor 3 reaches the rated load under various combustion conditions. In the process for increasing the load of the turbine 2, it is preferable to suppress increase in the amplitude value of the combustion oscillation to frequencies of the pressure waves generated by the combustion oscillation. In the third example, the combustor is capable of suppressing increase in the amplitude value of the combustion oscillation to each frequency of two kinds of pressure waves generated by the combustion oscillation. In other words, each combustion oscillation at two different frequencies may be suppressed.

Preferably, the gap is formed corresponding to the frequency (frequency of the combustion oscillation that occurs at the rated load) of the pressure wave under the combustion condition at the rated load of the turbine 2. Even at the rated load, the combustion oscillation at a plurality of frequencies may occur in response to change in fuel properties, fuel conditions, and fuel heat values. Even in the case of the combustion oscillation generated at different frequencies, the combustor according to the third example ensures to suppress the combustion oscillation.

As FIG. 5 illustrates, in the third example, the support 41*a* is disposed at the outer circumferential center of the premixer 34*a*. The vane 40*a* is attached to the support 41*a* at the side of the premixer 34*d*, and the vane 40*b* is attached to the support 41*a* at the side of the premixer 34*b*.

Specifically, in the circumferential direction of the premixer 34*a*, the gap between the outer circumferential surface of the combustion liner 7 and the inner circumferential surface of the vane 40 at one side of the support 41*a* is different from the gap at the other side of the support 41*a*. This structure will change the flow phase of the air for combustion to be introduced into the premixer 34*a* along its circumferential direction.

The premix flame properties may be made non-uniform in the circumferential direction of the ring-like shaped premix flame. The non-uniform premix flame properties may suppress increase in the amplitude value of the combustion oscillation.

Preferably, the combustor 3 according to the third example has the ribs 51 each disposed upstream and downstream from the pressure dynamics damping holes 42. This makes it possible to maintain the pressure wave attenuating performance.

The combustor according to the third example is capable of suppressing quantity of generated nitrogen oxides, maintaining the stable combustion state (stable flame burning), and suppressing the combustion oscillation that periodically fluctuates the pressure in the combustion chamber 8 (holding the amplitude value of the combustion oscillation at a predetermined level or lower).

The combustor according to the third example has a relatively simple structure, and is capable of suppressing increase in the amplitude value of the combustion oscillation generated in burning, securing the mechanical reliability of the member (vane 40) for attenuating the pressure fluctuation owing to the combustion oscillation.

The operation method as represented by FIG. 6 may be applied to the first and the second examples.

The present invention is not limited to the above-described examples, but includes various modifications. Specifically, the examples have been described in detail for readily understanding of the present invention. The present invention is not necessarily limited to the one provided with all structures as described above. It is possible to partially replace a structure of one of the examples with a structure of another example, or partially add the structure of one of the examples to the structure of another example. It is also possible to add, eliminate, and replace a part of the structure of one of the examples to, from, and with a part of the structure of another example.

REFERENCE SIGNS LIST

1 . . . compressor,
2 . . . turbine,
3 . . . combustor,
4 . . . generator,
5 . . . compressed air,
6 . . . compressed air passage,
7 . . . combustion liner,
8 . . . combustion chamber,
9 . . . combustion gas,
10 . . . transition piece,
11 . . . combustion casing,
12 . . . end cover,
13 . . . annular passage,
20 . . . diffusion burner,
21 . . . diffusion fuel supply system,
22 . . . fuel nozzle,
23 . . . swirler,
24 . . . diffusion fuel
25 . . . fuel jet hole,
26 . . . cone,
27 . . . air hole,
30 . . . premix burner,
31 . . . premix fuel supply system,
32 . . . fuel nozzle,
33 . . . premix fuel,
34 . . . premixer,
35 . . . flame stabilizer,
36 . . . premix burner partition,
40 . . . vane,
41 . . . support,
42 . . . pressure dynamics damping hole,
50 . . . flow sleeve,
51 . . . rib

What is claimed is:

1. A gas turbine combustor including a combustion liner that forms a combustion chamber for generating combustion gas, a combustion casing disposed at an outer circumferential side of the combustion liner, and a burner for supplying air flowing between the combustion liner and the combustion casing, and for supplying fuel from a fuel supply system to the combustion chamber, the gas turbine combustor comprising:

a plurality of vanes disposed at the outer circumferential side of the combustion liner, including a first vane and a second vane spaced apart from each other in a circumferential direction of the combustion liner;

a plurality of supports disposed at an inner side of the combustion casing for fixing the plurality of vanes, wherein a first pair of supports comprises a first support and a second support of the plurality of supports that are adjacent to the first vane for respectively fixing a first end of the first vane and a second end of the first vane, and the first end of the first vane is opposite to the second end of the first vane in the circumferential direction, and a second pair of supports comprises the second support and a third support of the plurality of supports that are adjacent to the second vane for respectively fixing a first end of the second vane and a second end of the second vane, and the first end of the second vane is opposite to the second end of the second vane in the circumferential direction; and a plurality of pressure dynamics damping holes, each formed in the combustion liner at a respective position corresponding to each of the plurality of vanes for communication with the combustion chamber, wherein the first vane and the second vane are disposed at mutually different positions in a radial direction of the combustion liner so that a first gap formed between an outer circumferential surface of the combustion liner and an inner circumferential surface of the first vane and a second gap formed between the outer circumferential surface of the combustion liner and an inner circumferential surface of the second vane, and the first gap and the second gap have different lengths in the radial direction, the length of the first gap in the radial direction is constant over the entire range in the circumferential direction from the first support of the first pair of supports to the second support of the first pair of supports, and all parts of each of the plurality of vanes face the outer circumferential surface of the combustion liner with a space therebetween.

2. The gas turbine combustor of claim 1, wherein the length of the second gap in the radial direction is constant over the entire range in the circumferential direction from the second support of the second pair supports to the third support of the second pair of supports.

* * * * *